US011649965B2

(12) United States Patent
Cerutti

(10) Patent No.: US 11,649,965 B2
(45) Date of Patent: May 16, 2023

(54) FUEL NOZZLE FOR A GAS TURBINE WITH RADIAL SWIRLER AND AXIAL SWIRLER AND GAS TURBINE

(71) Applicant: NUOVO PIGNONE TECNOLOGIE SRL, Florence (IT)

(72) Inventor: Matteo Cerutti, Florence (IT)

(73) Assignee: NUOVO PIGNONE TECNOLOGIE SRL, Florence (IT)

( * ) Notice: Subject to any disclaimer, the term of this patent is extended or adjusted under 35 U.S.C. 154(b) by 79 days.

(21) Appl. No.: 16/302,556

(22) PCT Filed: May 30, 2017

(86) PCT No.: PCT/EP2017/063044
§ 371 (c)(1),
(2) Date: Nov. 16, 2018

(87) PCT Pub. No.: WO2017/207573
PCT Pub. Date: Dec. 7, 2017

(65) Prior Publication Data

US 2019/0170356 A1 Jun. 6, 2019

(30) Foreign Application Priority Data

May 31, 2016 (IT) ..... 102016000056306

(51) Int. Cl.
*F23R 3/14* (2006.01)
*F23R 3/28* (2006.01)
(Continued)

(52) U.S. Cl.
CPC ..... *F23R 3/286* (2013.01); *F23D 14/08* (2013.01); *F23D 14/62* (2013.01); *F23D 14/64* (2013.01);
(Continued)

(58) Field of Classification Search
CPC ..... F23R 3/12; F23R 3/14; F23R 3/286–32; F23D 2900/14021; F23D 2900/14701; F23C 2900/07001
See application file for complete search history.

(56) References Cited

U.S. PATENT DOCUMENTS 4,726,182 A * 2/1988 Barbier ..... F23R 3/14 60/39.23
4,754,600 A * 7/1988 Barbier ..... F23C 7/008 60/39.23
(Continued)

FOREIGN PATENT DOCUMENTS

EP 1186832 A2 3/2002
EP 1909030 A2 4/2008
(Continued)

OTHER PUBLICATIONS

PCT Search Report and Written Opinion issued in connection with corresponding Application No. PCT/EP2017/063044 dated Jul. 26, 2017.

*Primary Examiner* — Todd E Manahan
*Assistant Examiner* — Marc J Amar
(74) *Attorney, Agent, or Firm* — Baker Hughes Patent Org

(57) ABSTRACT

The fuel nozzle for the gas turbine includes a radial swirler and an axial swirler. The radial swirler is arranged to swirl a first flow of a first oxidant-fuel mixture and the axial swirler is arranged to swirl a second flow of a second oxidant-fuel mixture. The first flow may be fed by a central conduit and the second flow may be fed by an annular conduit surrounding the central conduit.

13 Claims, 5 Drawing Sheets

(51) Int. Cl.
*F23R 3/34* (2006.01)
*F23D 14/08* (2006.01)
*F23D 14/62* (2006.01)
*F23D 14/64* (2006.01)

(52) U.S. Cl.
CPC ..... *F23R 3/14* (2013.01); *F23R 3/343* (2013.01); *F23C 2900/07001* (2013.01); *F23D 2206/10* (2013.01); *F23D 2900/14021* (2013.01); *F23D 2900/14701* (2013.01)

(56) References Cited

U.S. PATENT DOCUMENTS 5,295,352 A * 3/1994 Beebe ..... F23D 14/02 239/404
5,647,538 A * 7/1997 Richardson ..... F23D 11/101 239/405
5,836,164 A * 11/1998 Tsukahara ..... F23C 6/047 60/733
5,941,075 A * 8/1999 Ansart ..... F23R 3/14 60/737
6,237,343 B1 * 5/2001 Butler ..... F23R 3/40 60/723
6,389,815 B1 * 5/2002 Hura ..... F23R 3/346 60/746
7,926,744 B2 * 4/2011 Thomson ..... F23R 3/14 239/405
9,222,666 B2 * 12/2015 Liu ..... F23D 14/02
10,132,499 B2 * 11/2018 Matsuyama ..... F23R 3/286
10,648,671 B2 * 5/2020 Kobayashi ..... F23R 3/16
2002/0011064 A1 * 1/2002 Crocker ..... F23D 11/107 60/776
2002/0162333 A1 * 11/2002 Zelina ..... F23R 3/286 60/776
2004/0103664 A1 * 6/2004 Held ..... F23R 3/286 60/746
2008/0078181 A1 * 4/2008 Mueller ..... F23R 3/286 60/776
2008/0276622 A1 * 11/2008 Johnson ..... F23R 3/36 60/800
2009/0212139 A1 * 8/2009 Thomson ..... F23R 3/28 239/590
2010/0071373 A1 3/2010 Martin et al.
2010/0126176 A1 5/2010 Kim
2012/0186258 A1 * 7/2012 Dai ..... F23R 3/286 60/748
2012/0304649 A1 * 12/2012 Matsuyama ..... F23R 3/286 60/737
2012/0305673 A1 * 12/2012 Matsuyama ..... F23R 3/343 239/533.2
2013/0020413 A1 * 1/2013 Jones ..... F23R 3/343 239/533.2
2013/0174563 A1 * 7/2013 Boardman ..... F23R 3/286 60/772
2013/0327849 A1 * 12/2013 Matsuyama ..... F23R 3/286 239/406
2014/0083105 A1 * 3/2014 Kobayashi ..... F23R 3/28 60/746
2014/0144143 A1 * 5/2014 Sanderson ..... F23R 3/286 60/737
2015/0121882 A1 * 5/2015 Dai ..... F23R 3/14 60/737
2016/0010856 A1 1/2016 Biagioli et al.
2017/0227226 A1 * 8/2017 Max ..... F23R 3/286
2018/0128491 A1 * 5/2018 Boardman ..... F23R 3/04
2018/0372319 A1 * 12/2018 Matsuyama ..... F23D 11/107
2019/0024901 A1 * 1/2019 Sadasivuni ..... F23R 3/343

FOREIGN PATENT DOCUMENTS

EP 2716976 A1 4/2014
EP 3043116 A1 * 7/2016 ..... F23R 3/286

* cited by examiner

FUEL NOZZLE FOR A GAS TURBINE WITH RADIAL SWIRLER AND AXIAL SWIRLER AND GAS TURBINE

TECHNICAL FIELD

Embodiments of the subject matter disclosed herein correspond to fuel nozzles for gas turbines with radial swirler and axial swirler and gas turbines using such nozzles.

BACKGROUND

Stability of the flame and low NOx emission are important features for fuel nozzles of a burner of a gas turbine.

This is particularly true in the field of "Oil & Gas" (i.e. machines used in plants for exploration, production, storage, refinement and distribution of oil and/or gas).

For this purpose, swirlers are used in the fuel nozzles of gas turbines.

A double radial swirler is disclosed, for example, in US2010126176A1.

An axial swirler is disclosed, for example, in US2016010856A1.

A swirler wherein a radial flow of air and an axial flow of air are combined to form a single flow of air is disclosed, for example, in U.S. Pat. No. 4,754,600; there is a single recirculation zone that can be controlled.

BRIEF DESCRIPTION OF THE INVENTION

In order to achieve this goal, both a radial swirler and an axial swirler are integrated in a single fuel nozzle.

Recirculation in the combustion chamber, that is a stabilization mechanism, may depend on the load of the gas turbine, e.g. low load, intermediate load, high load.

Depending of the load of the gas turbine, recirculation in the combustion chamber may be provided only or mainly by the radial swirler, or only or mainly by the axial swirler, or by both swirlers.

Embodiments of the subject matter disclosed herein relate to fuel nozzles for gas turbines.

According to embodiments, a fuel nozzle comprises a radial swirler and an axial swirler; the radial swirler is arranged to swirl a first flow of a first oxidant-fuel mixture and the axial swirler is arranged to swirl a second flow of a second oxidant-fuel mixture. The first flow may be fed by a central conduit and the second flow may be fed by an annular conduit surrounding the central conduit.

Additional embodiments of the subject matter disclosed herein relate to gas turbines.

According to embodiments, a gas turbine comprises at least one fuel nozzle with a radial swirler and an axial swirler.

BRIEF DESCRIPTION OF DRAWINGS

The accompanying drawings, which are incorporated herein and constitute an integral part of the present specification, illustrate exemplary embodiments of the present invention and, together with the detailed description, explain these embodiments. In the drawings.

DETAILED DESCRIPTION

The following description of exemplary embodiments refers to the accompanying drawings.

The following description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
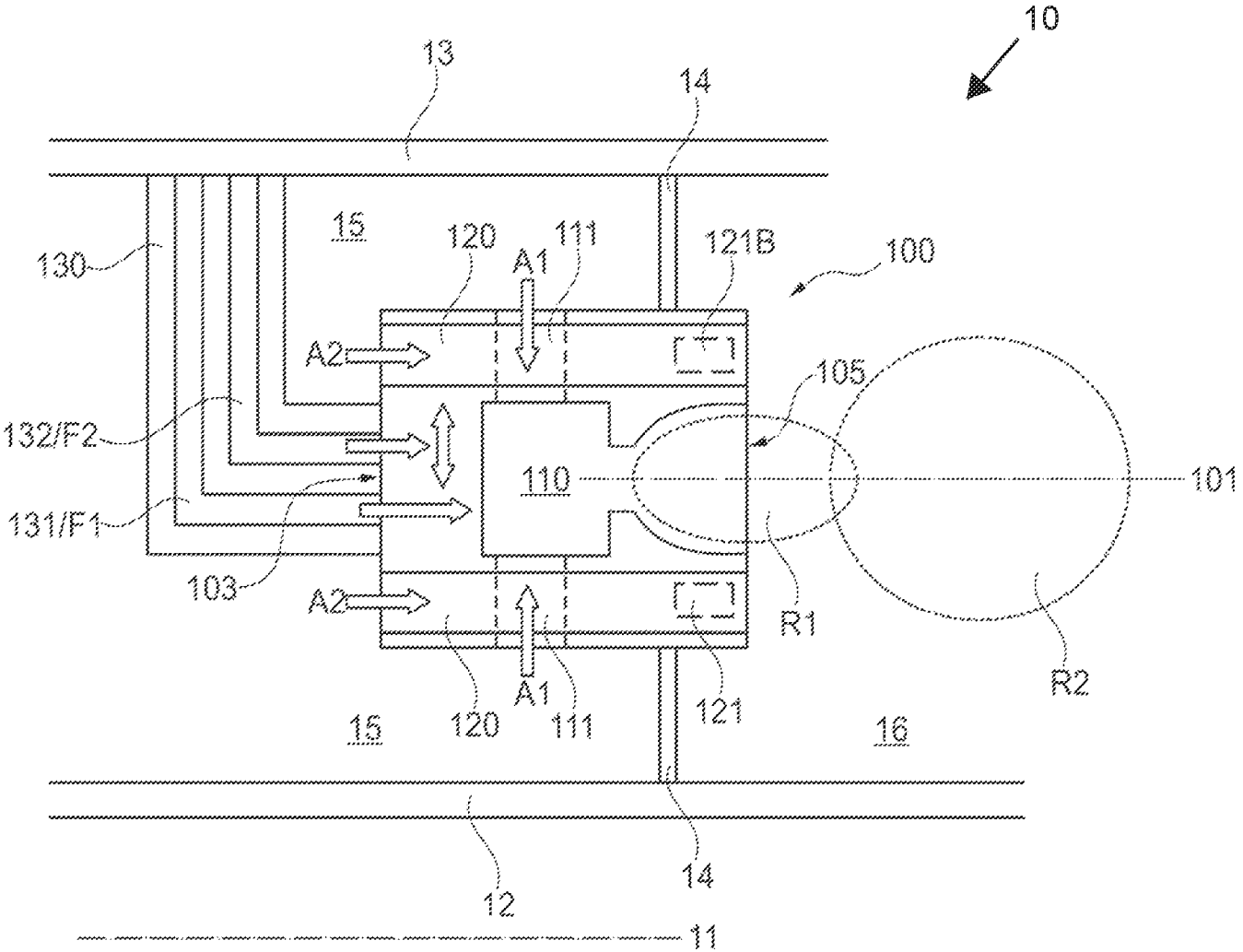
FIG. 1 shows a partial longitudinal cross-section view of a burner of a gas turbine wherein an embodiment of a fuel nozzle is located.

FIG. 1 shows a partial longitudinal cross-section view of a burner 10 of a gas turbine 1 wherein an embodiment of a fuel nozzle 100 is located.

The burner 10 is annular-shaped, has a axis 11, an internal (e.g. cylindrical) wall 12 and an external (e.g. cylindrical) wall 13. A transversal wall 14 divides a feeding plenum 15 of the burner 10 from a combustion chamber 16 of the burner 10; the feeding plenum 15 is in fluid communication with a discharge chamber of a compressor of the gas turbine 1. The burner 10 comprises a plurality of nozzles 100 arranged in a crown around the axis 11 of the burner 10. The wall 14 has a plurality of (e.g. circular) holes wherein a corresponding plurality of (e.g. cylindrical) bodies of the nozzles 100 are fit. Furthermore, each nozzle 100 has a support arm 130, in particular an L-shaped arm, for fixing the nozzle 100, in particular for fixing it to the external wall 13.

The nozzle 100 comprises a radial swirler, that is shown schematically in FIG. 1 as element 111, and an axial swirler, that is shown schematically in FIG. 1 as element 121B. As it will be described better with the help of FIG. 2 and FIG. 3 and FIG. 4, the axial swirler essentially consists of a set of vanes 121 and the radial swirler essentially consists of a set of channels 111; the vanes 121 develop substantially axially and the channels 111 develop substantially radially. It is to be noted that, in the embodiment of FIG. 2 and FIG. 3 and FIG. 4, each vane has a straight portion 121A and a curved portion 121B (downstream the straight portion 121A); the curved portion 121B provides radial swirl to a flowing gas (as explained in the following) and the straight portion 121A houses a channel 111, i.e. is hollow.

A body of the nozzle 100 develops in an axial direction, i.e. along an axis 101, from an inlet side 103 of the nozzle to an outlet side 105 of the nozzle; the body may be, for example, cylindrical-shaped, cone-shaped, prism-shaped or pyramid-shaped.

The body of the nozzle 100 comprises a central conduit 110 developing in the axial direction 101 and an annular conduit 120 developing in the axial direction 101 around the central conduit 110. The annular conduit 120 houses the vanes 121. The channels 111 start on an outer surface of the body, pass through the straight portions 121A of the vanes 121 and end in a chamber 112 being in a central region of the body; the chamber 112 is the start of the central conduit 110. The channels 111 provide axial swirl to a flowing gas (as explained in the following).

Inside arm 130 there is at least a first pipe 131 for feeding a first fuel flow F1 to the body of the nozzle 100, in particular to its inlet side 103, and a second pipe 132 for feeding a second fuel flow F2 to the body of the nozzle 100, in particular to its inlet side 103; there may be other pipes, in particular for other fuel flows.

A first flow A1 of oxidant, in particular air, enters the central conduit 110 from the plenum 15 (in particular from the lateral side of the nozzle body through channels 111); a second flow A2 of oxidant, in particular air, enters the annular conduit 120 from the plenum 15 (in particular from the inlet side 103 of the nozzle body).

The first fuel flow F1 is injected axially into the central conduit 110 (this is not shown in FIG. 1, but only in FIG. 2) and mixes with the first oxidant flow A1; the second fuel flow F2 is injected radially into the annular conduit 120 (this is not shown in FIG. 1, but only in FIG. 2) and mixes with the second oxidant flow A2.

The channels 111 are tangential and are arranged to create radially swirling motion in the central conduit 110 around the axial direction 101. The first fuel flow F1 enters the chamber 112 tangentially and mixes with the first oxidant flow A1 so a first flow A1+F1 of a first oxidant-fuel mixture is created with radially swirling motion (in particular in the center of the nozzle body). The first oxidant flow A1 and the first fuel flow F1 are components of the first flow A1+F1.

The second oxidant flow A2 enters the annular conduit 120 axially and mixes with the second oxidant flow A2 so a second flow A2+F2 of a second oxidant-fuel mixture is created with axially directed motion. The second oxidant flow A2 and the second fuel flow F2 are components of the second flow A2+F2. Feeding channels 122 are defined between airfoil portions of adjacent swirl vanes 121 and arranged to feed the second flow A2−F2. The second flow A2+F2 flows in the channels 122 first between the straight portions 121A of the vanes 121 and then between the curved portions 121B so a flow with axially swirling motion is created (in particular close to the outlet side 105 of the nozzle body).

The central conduit 110 is arranged to feed the first flow A1+F1 to the outlet side 105 of the nozzle body and the annular conduit 120 is arranged to feed the second flow A2+F2 to the outlet side 105 of the nozzle body.

A first recirculation zone R1 is associated to the radial swirler, and a second recirculation zone R2 is associated to the axial swirler. In the embodiments of the figures, the second recirculation zone R2 is at least partially downstream the first recirculation zone R1.

Figure 2:
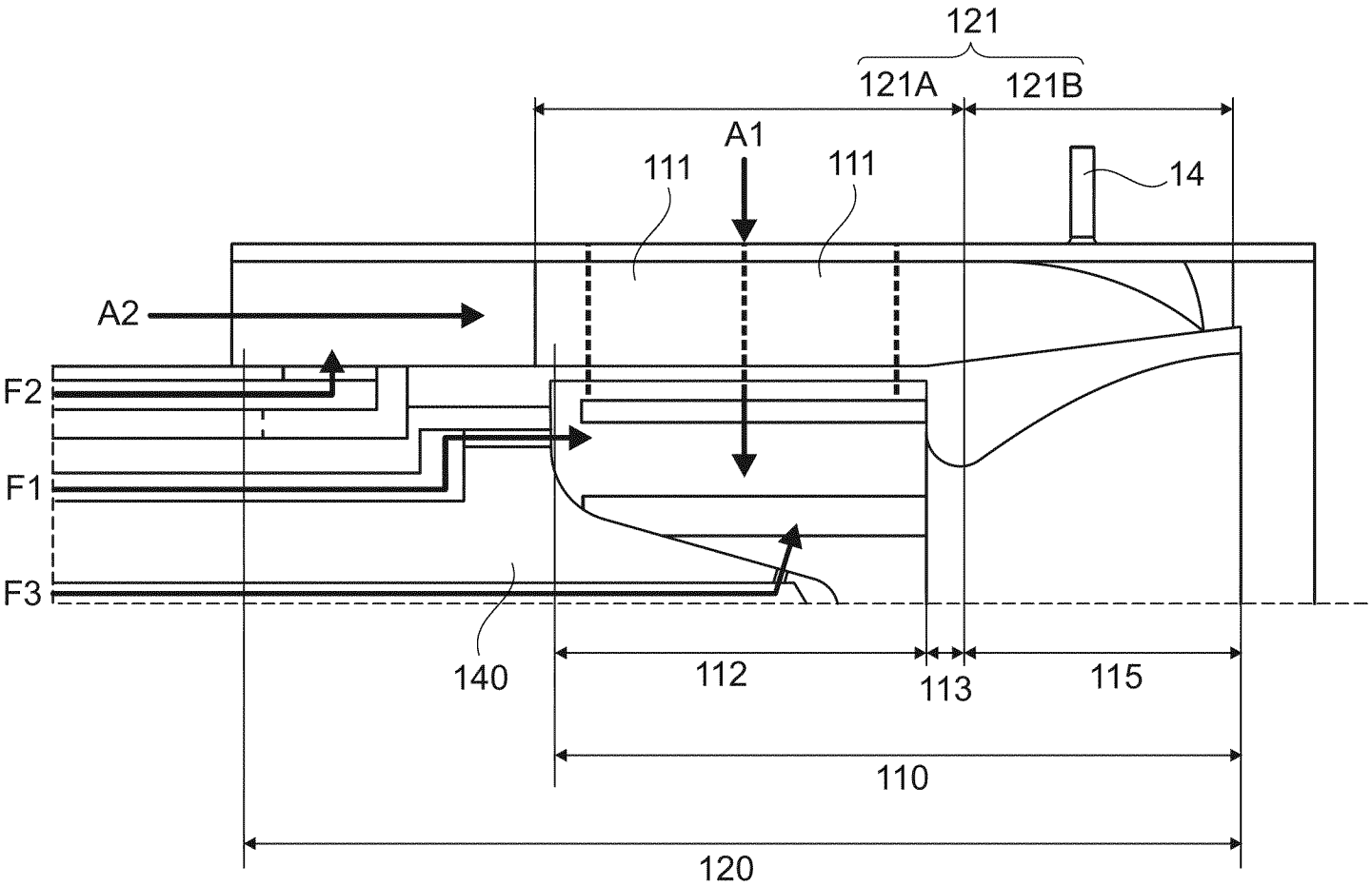
FIG. 2 shows a partial longitudinal cross-section view of the nozzle of FIG. 1.

With reference to FIG. 2, the central conduit 110 starts with the chamber 112, follows with a converging section 113 (converging with respect to the axial direction 101), and ends with a diverging section 115 (diverging with respect to the axial direction 101). In FIG. 2, the constricted section, after the section 113 and before section 115, is extremely short. The converging section may correspond to an abrupt (as in FIG. 2) or a gradual cross-section reduction. The diverging section corresponds typically to a gradual cross-section increase.

In the embodiment of FIG. 2, the end of the diverging section 115 of the central conduit 110 and the end of the annular conduit 120 are axially aligned at the outlet side 105 of the nozzle body.

In the embodiment of FIG. 2, the feeding channels 111 end in a region of the central conduit 110, in particular in the chamber 112, before the converging section 113 of the central conduit 110.

Figure 4:
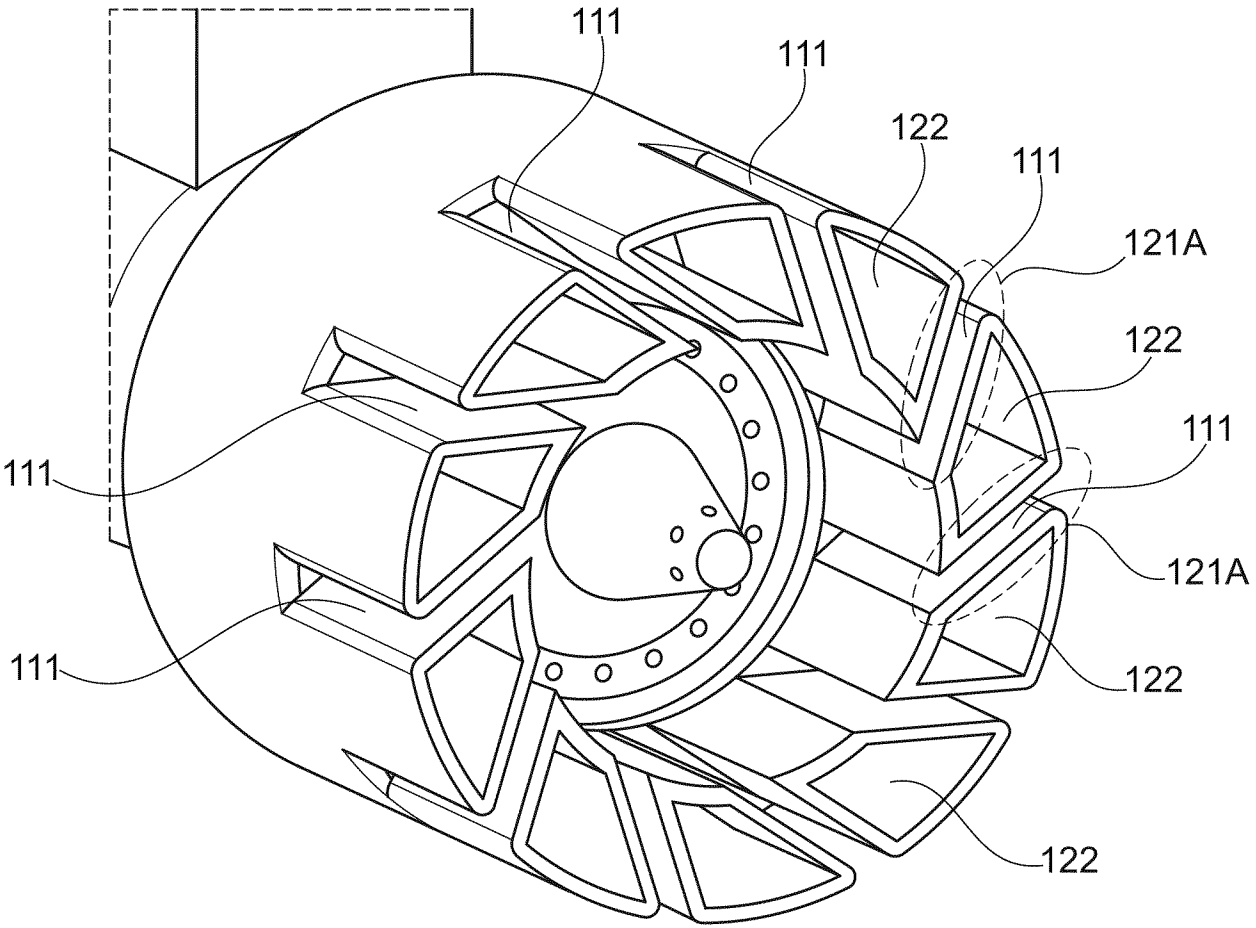
FIG. 4 shows a front three-dimensional view of the nozzle of FIG. 1, transversally cross-sectioned at the radial swirler.

As can be seen in FIG. 2, inside the nozzle body, there are annular pipes that feed the first input fuel flow F1 to the central conduit 110 through a first plurality of little (lateral) holes, in particular to the chamber 112, and the second input fuel flow F2 to the annular conduit 120 through a second plurality of little (front) holes (see FIG. 4).

Figure 3:
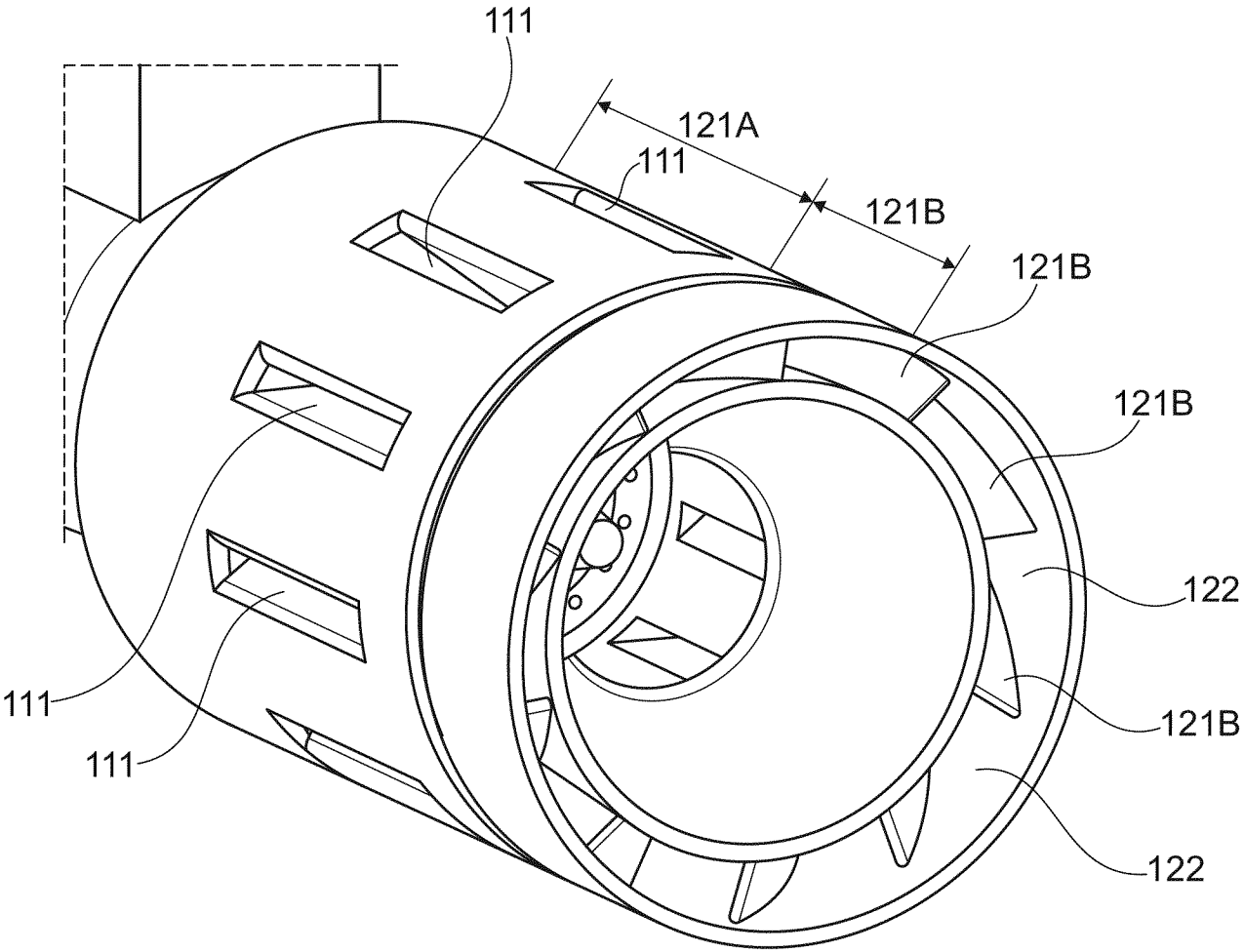
FIG. 3 shows a front three-dimensional view of the nozzle of FIG. 1.

The nozzle of FIG. 2 and FIG. 3 and FIG. 4 comprises further a pilot injector 140 located in the center of the central conduit 110, in particular partially in the chamber 112. The pilot injector 140 receives a third fuel flow F3 from a third pipe inside the support arm of the nozzle. The pilot injector 140 is cone-shaped at its end and an internal pipe feed the third fuel flow F3 to its tip. A plurality of little holes at the tip (see FIG. 4) eject the fuel into the central conduit 110, in particular into the chamber 112, in particular shortly upstream the converging section 113.

Figure 5:
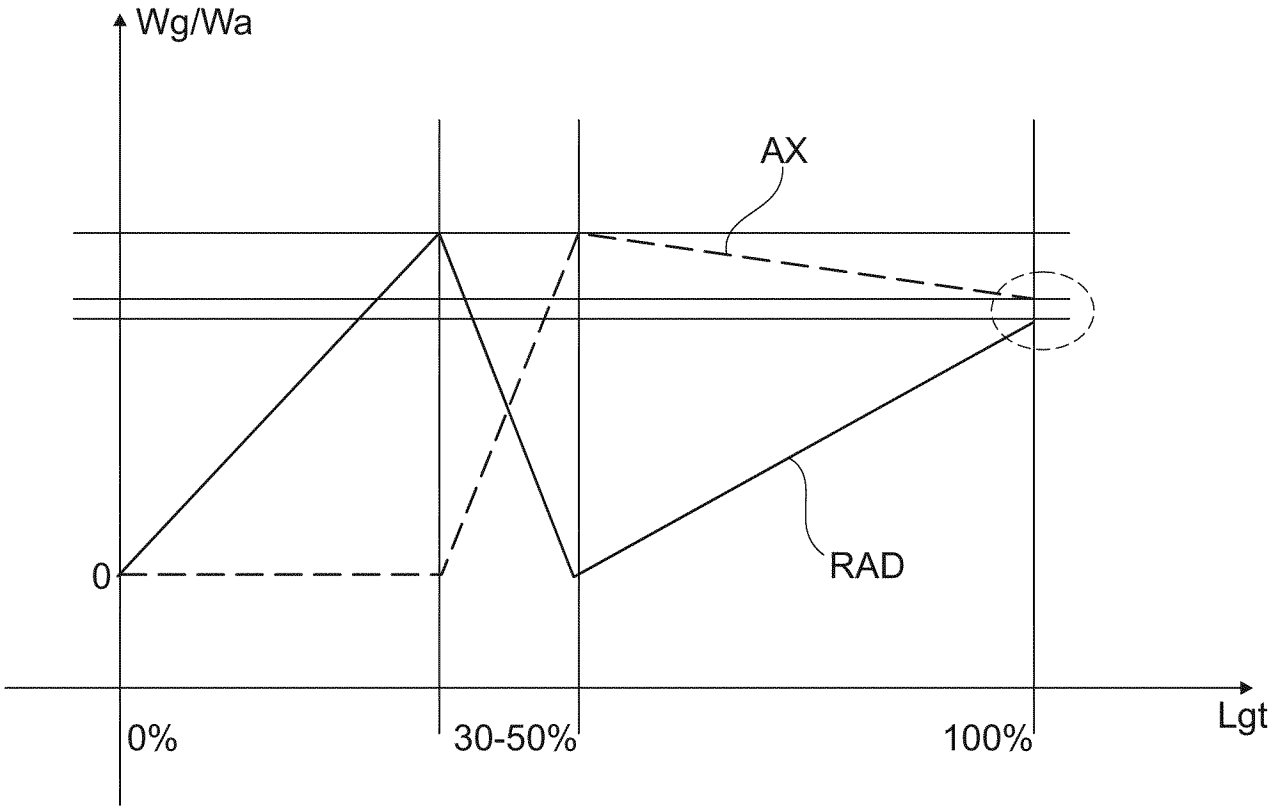
FIG. 5 shows two plots of Wg/Wa ratios of swirlers.

FIG. 5 shows two plots: a first plot (continuous line labelled RAD) is a possible plot of a ratio between fuel gas mass flow rate Wg and oxidant gas (typically air) mass flow rate Wa in the radial swirler, and a second plot (dashed line labelled AX) is a possible plot of a ratio between fuel gas mass flow rate Wg and oxidant gas (typically air) mass flow rate Wa in the axial swirler. As it is known, the temperature of a flame is linked to the ratio between fuel gas mass flow rate and oxidant gas mass flow rate.

Both plots start from 0 at zero (or approximately zero) load of the gas turbine Lgt.

According to this embodiment, for example, both plots end approximately at the same point (the two points are not necessarily identical) at full (or approximately full) load of the gas turbine Lgt. In fact, it may be advantageous that the flame due to the radial swirler and the flame due to the axial swirler are approximately at the same temperature.

According to this embodiment, for example, the axial ratio is rather constant and approximately zero between 0% of load of the gas turbine and 30% of load of the gas turbine.

According to this embodiment, for example, the axial ratio is rather constant (to be precise, slowly decreasing) between 50% of load of the gas turbine and 100% of load of the gas turbine.

According to this embodiment, for example, the radial ratio gradually increases between 0% of load of the gas turbine and 30% of load of the gas turbine.

According to this embodiment, for example, the radial ratio gradually increases between 50% of load of the gas turbine and 100% of load of the gas turbine.

According to this embodiment, for example, the radial ratio drastically decreases between 30% of load of the gas turbine and 50% of load of the gas turbine.

According to this embodiment, for example, the axial ratio drastically increases between 30% of load of the gas turbine and 50% of load of the gas turbine.

The fuel gas mass flow rate in the radial swirler, in the axial swirler or in both swirlers may be controlled through a control system comprising for example a controlled valve or controlled movable diaphragm.

The oxidant gas mass flow rate in the radial swirler, in the axial swirler or in both swirlers may be controlled through a control system for example a controlled valve or controlled movable diaphragm.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fuel nozzle for a gas turbine comprising:

a nozzle body defining a longitudinal axis, a central conduit developing in a direction along the longitudinal axis and an annular conduit developing around the central conduit;

a radial swirler configured to swirl a first flow of a first oxidant-fuel mixture that flows through the central conduit;

an axial swirler arranged to swirl a second flow of a second oxidant-fuel mixture that flows through the annular conduit;

a first shroud defining a downstream end of the central conduit and encompassing the first flow from the radial swirler; and a second shroud defining a downstream end of the annular conduit and encompassing the second flow from the axial swirler, wherein the central conduit and the annular conduit keep the first flow and the second flow separate until both exit at an outlet, and wherein the first shroud and the second shroud both terminate at a plane perpendicular to the longitudinal axis.

2. The fuel nozzle of claim 1, wherein a first recirculation zone is associated to the radial swirler, wherein a second recirculation zone is associated to the axial swirler, and wherein the second recirculation zone is at least partially downstream of the first recirculation zone.

3. The fuel nozzle of claim 1, wherein the annular conduit comprises a plurality of swirl vanes arranged to axially swirl the second flow.

4. The fuel nozzle of claim 3, wherein the plurality of swirl vanes are hollow and are arranged to feed a first component of the first flow radially to the central conduit.

5. The fuel nozzle of claim 4, wherein first feeding channels are formed between the plurality of swirl vanes that are adjacent to one another and arranged to feed the first component, wherein the first feeding channels create radially swirling motion in the central conduit around the axial direction.

6. The fuel nozzle of claim 5, being arranged to inject a second component of the first flow to the central conduit and mix it with the first component thereby obtaining the first flow with radially swirling motion.

7. The fuel nozzle of claim 1, wherein the central conduit has a converging section and a diverging section following the converging section.

8. The fuel nozzle of claim 3, wherein second feeding channels are defined between airfoil portions of the plurality of swirl vanes that are adjacent to one another and arranged to feed the second flow.

9. The fuel nozzle of claim 8, wherein the fuel nozzle is arranged to mix a first component and a second component of the second flow in the annular conduit upstream the plurality of swirl vanes.

10. The fuel nozzle of claim 8, wherein the plurality of swirl vanes comprise first portions being essentially straight and second portions being curved, the second portions being located downstream the first portions and arranged to axially swirl the second flow.

11. The fuel nozzle of claim 10, wherein first feeding channels are located between the first portions of the swirl vanes.

12. The fuel nozzle of claim 1, further comprising a pilot injector located in the center of the central conduit.

13. A gas turbine comprising at least one fuel nozzle according to claim 1.

* * * * *